US005354182A

United States Patent [19]

Niemiec et al.

[11] Patent Number: 5,354,182

[45] Date of Patent: Oct. 11, 1994

[54] UNITARY ELECTRIC-MOTOR/HYDRAULIC-PUMP ASSEMBLY WITH NOISE REDUCTION FEATURES

[75] Inventors: Albin J. Niemiec, Sterling Heights; George M. Russell, St. Clair Shores; Ronald B. Schweiger, Clawson; Otto P. Langosch, Rochester, all of Mich.

[73] Assignee: Vickers, Incorporated, Maumee, Ohio

[21] Appl. No.: 61,237

[22] Filed: May 17, 1993

[51] Int. Cl.[5] ..... F04B 19/00

[52] U.S. Cl. ..... 417/363; 417/366; 417/423.15; 248/638

[58] Field of Search ..... 417/366, 363, 423.14, 417/423.15, 357; 248/638, 632

[56] References Cited

U.S. PATENT DOCUMENTS

| | | | |
|---|---|---|---|
| 2,204,510 | 6/1940 | Neeson | 417/363 |
| 2,612,843 | 10/1952 | Gruetjen | 417/423.14 |
| 2,993,449 | 7/1961 | Harland | 417/357 |
| 3,333,544 | 8/1967 | Truck | 417/357 |
| 3,937,598 | 2/1976 | Stannow et al. | 417/363 |
| 4,065,082 | 10/1976 | Oota | 248/632 |
| 4,425,813 | 1/1984 | Wadensten | 248/638 |
| 4,746,092 | 5/1988 | Hayashi et al. | 248/638 |
| 4,768,925 | 9/1988 | Geupel | 417/363 |
| 4,897,023 | 1/1990 | Bingler | 417/423.15 |
| 4,946,351 | 8/1990 | Richardson, Jr. | 248/638 |
| 5,181,837 | 1/1993 | Niemiec | 417/350 |

FOREIGN PATENT DOCUMENTS

| | | | |
|---|---|---|---|
| 108481 | 7/1982 | Japan | 417/363 |
| 104378 | 6/1983 | Japan | 417/363 |
| 11475 | 1/1986 | Japan | 417/363 |
| 241473 | 10/1986 | Japan | 417/363 |
| 35084 | 2/1987 | Japan | 417/363 |
| 159777 | 7/1987 | Japan | 417/363 |
| 29090 | 2/1988 | Japan | 417/363 |
| 205476 | 8/1988 | Japan | 417/363 |
| 4244601 | 9/1992 | Japan | 417/363 |

OTHER PUBLICATIONS

"Noise Control in Hydraulic Systems", Vickers, Incorporated, Pub. No. 510-H91GG (1991).

*Primary Examiner*—Richard A. Bertsch
*Assistant Examiner*—Roland G. McAndrews, Jr.
*Attorney, Agent, or Firm*—Barnes, Kisselle, Raisch, Choate, Whittemore & Hulbert

[57] ABSTRACT

An electric-motor/hydraulic-pump assembly in which an electric motor has a motor housing and a motor drive shaft, and a hydraulic pump is mounted directly to one end of the motor housing and internally coupled to the shaft to form a unitary assembly in which vibration generated by operation of the pump is transmitted to the motor housing. Support feet are affixed to the motor housing for mounting the motor/pump assembly to underlying support structure, and sound deadening ferrules are interposed between the motor housing and the support feet to inhibit transmission of structureborne noise from the motor housing to the support structure. The motor and pump are surrounded by a sound enclosure to inhibit radiation of airborne noise into the surround atmosphere. Fluid is drawn through an inlet in the sound enclosure and through the motor housing to cool the motor, and then pumped to a fluid outlet in the enclosure.

2 Claims, 6 Drawing Sheets

UNITARY ELECTRIC-MOTOR/HYDRAULIC-PUMP ASSEMBLY WITH NOISE REDUCTION FEATURES

The present invention is directed to electric motors and hydraulic pumps provided in the form of a unitary motor/pump assembly, and more particularly to suppression of audible noise radiated by the motor housing.

BACKGROUND AND OBJECTS OF THE INVENTION

In unitary electric-motor/hydraulic-pump assemblies, the pump portion of the assembly is mounted on one end of the housing of the electric motor and coupled to the motor shaft within the assembly. During operation of the pump, reaction forces generated by the pumping members are transmitted to the pump support structure and through the bearings to the pump shaft. This vibration energy is therefore transmitted both directly to the motor housing, and through the shaft to the motor components and thence to the motor housing, which provides a large surface for radiating energy into the surrounding atmosphere as audible noise. Furthermore, noise is generated by vibration through the motor housing mounting feet to the support structure on which the motor/pump assembly is mounted.

Noise radiation in industrial environments is of increasing concern from the standpoint of health and safety of equipment operators. It has heretofore been proposed to place isolation pads between the motor mounting feet and the underlying support structure to inhibit transmission of vibration noise to the support structure. See "Noise Control in Hydraulic Systems" published by applicant's assignee in 1991, Publication No. 510-H91GG. When a load is applied to the motor, the reaction torque is supported by one set of isolation pads, and the opposite set is unloaded. If the isolation pads on the unloaded side do not include material between the motor foot and the tie-down bolts, the vibration noise will be transmitted directly to the support structure. Moreover, such isolation pads have no substantial effect on radiation of noise from the motor housing.

It is a general object of the present invention to provide a unitary electric-motor/hydraulic pump assembly of the described character that includes facility for suppression of noise radiated into the atmosphere from the motor/pump housing, and/or suppression of vibration transmitted directly from the motor housing to the underlying pump/motor assembly support structure.

SUMMARY OF THE INVENTION

An electric-motor/hydraulic-pump assembly in accordance with the present invention includes an electric motor having a motor housing and a motor shaft accessible at one end of the housing. A hydraulic pump is mounted to the end of the motor housing and coupled to the shaft to form a unitary assembly in which vibration noise generated by operation of the pump is transmitted to the motor housing. In accordance with one aspect of the present invention, support feet are affixed to the motor housing for mounting the motor housing to housing support structure, and sound deadeners are operatively interposed between the motor housing and the support feet to inhibit transmission of vibration from the motor housing to the support structure through the support feet. The support feet have an opening through which a fastener extends and is threaded into the motor housing. The sound deadening structure comprises a ferrule of rubber or other resilient material radially surrounding the bolt within the foot opening. The ferrule has a first end flange axially interposed between the head of the bolt and the support foot, and a second end flange axially interposed between the support foot and the motor housing. The ferrule thus functions to inhibit direct transmission of structureborne noise from the motor housing to the underlying support structure by suppression of axial, torsional and radial vibration between the motor housing and the support structure.

In accordance with a second aspect of the present invention, the motor and pump is enclosed by a sound deadening enclosure to inhibit radiation of airborne noise from the pump and motor housings. This aspect of the present invention finds particular utility in motor/-pump assemblies in which the motor is cooled by fluid fed to the pump. In such fluid-cooled motor/pump assemblies, the usual air cooling fan and shroud may be eliminated, and the motor/pump unit may be enclosed by a sound deadening enclosure without overheating the motor. In the preferred embodiments of the invention that embody both a sound deadening enclosure and isolation ferrules at the motor mounting feet, the feet are bolted to the motor housing through the ferrules within the sound deadening enclosure to inhibit both transmission of both structureborne and airborne noise to the surrounding environment.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
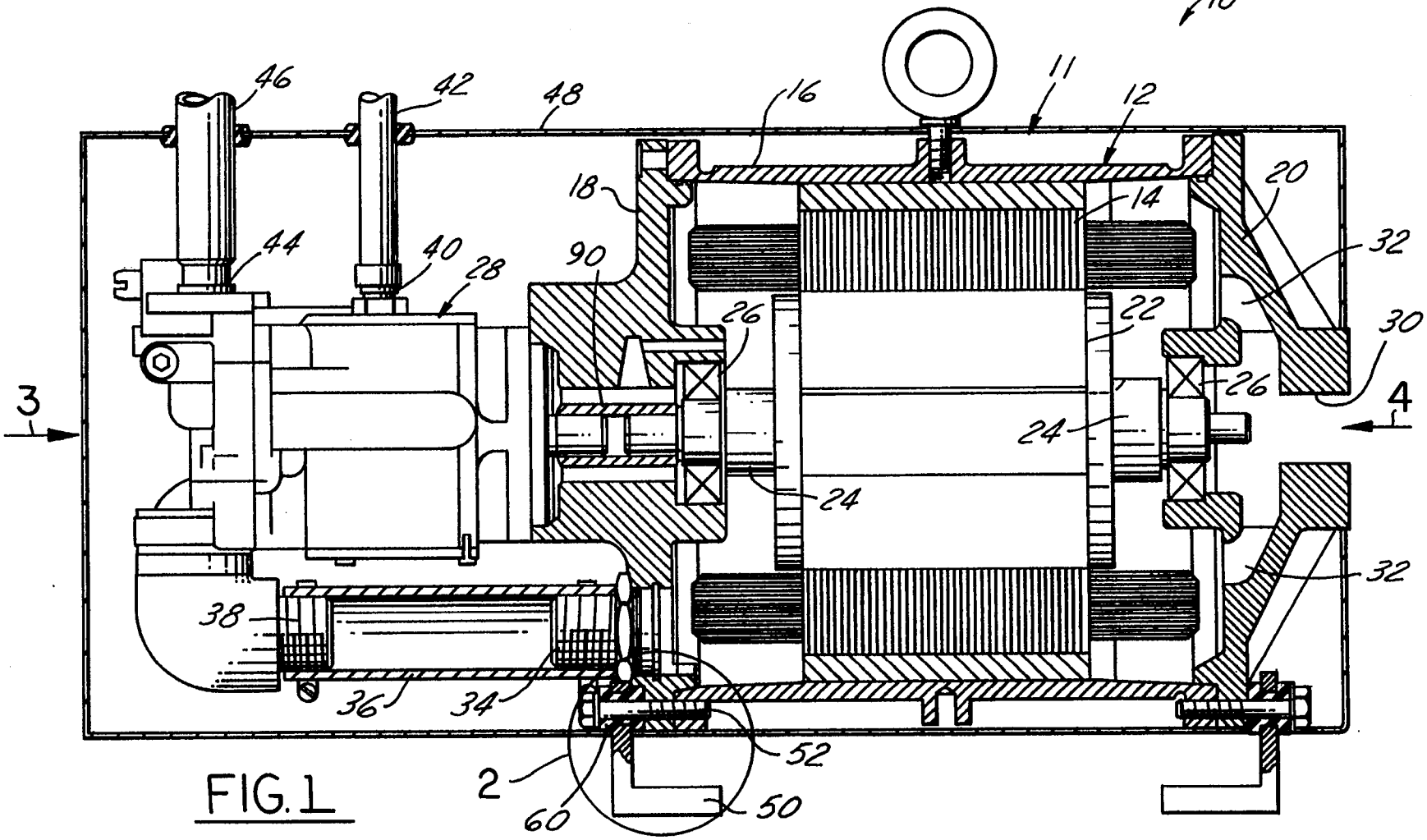
FIG. 1 is a side elevational view that bisects an electric- motor/hydraulic-pump assembly in accordance with one presently preferred embodiment of the invention.

FIGS. 1–4 illustrate an electric-motor/hydraulic-pump assembly 10 in accordance with a presently preferred embodiment of the invention as comprising an electric motor 11 having a stator 14 mounted within a motor housing 12 that includes a generally cylindrical case 16 and a pair of end members 18,20 affixed to the case. A rotor 22 is mounted on a shaft 24 that is carried by bearings 26 in end members 18,20. An in-line piston pump unit 28 is mounted on end member 18 and coupled to shaft 24 by a coupler 90. Piston pump 28 may be of any suitable construction. A fluid inlet 30 is formed in end member 20 coaxially with shaft 24 for feeding hydraulic fluid through internal end member radial passages 32 into the interior of motor housing 12. A fitting 34 on end member 18 is connected by a conduit 36 to an inlet fitting 38 on piston pump unit 28. Pump unit 28 also has a case drain fitting 40 connected to a conduit 42, and an outlet port or fitting 44 connected to a conduit 46. A sound deadening enclosure 48 surrounds and encloses motor housing 12 (including end member 20) and pump unit 28, and is radially spaced therefrom for inhibiting radiation of vibration energy from the motor housing and pump as audible noise into the surrounding atmosphere. Fluid inlet 30, case drain conduit 42 and outlet conduit 46 extend through housing 48.

The motor and pump thus form a unitary assembly 10 in which hydraulic fluid is fed to the pump through the interior of motor housing 12 so as to cool the motor components. The particular embodiment illustrated in FIGS. 1–4 comprises a so-called hybrid motor/pump unit, in which cooling fluid is passed through the motor and then outside of the unit to the pump. It will be apparent, however, that the invention applies equally as well to so-called close-coupled motor/pump units in which the fluid is fed directly from the motor interior to the pump, and also to so-called integrated units of the type shown in U.S. Pat. No. 5,181,837, in which the motor and pump share components such as end member 18. An impeller may be mounted on shaft 24 adjacent to inlet 30 for boosting inlet fluid pressure fed to the motor housing interior.

Figure 2:
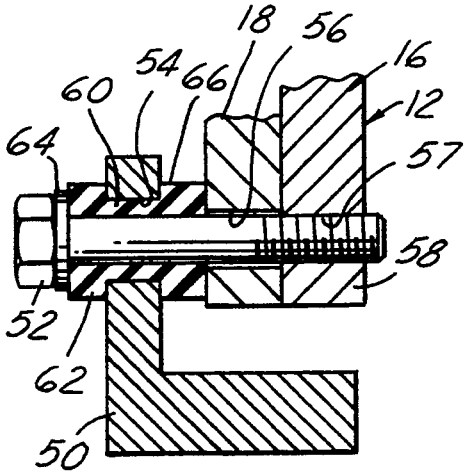
FIG. 2 is a fragmentary view on an enlarged scale of the portion of FIG. 1 within the circle 2.
Figure 3:
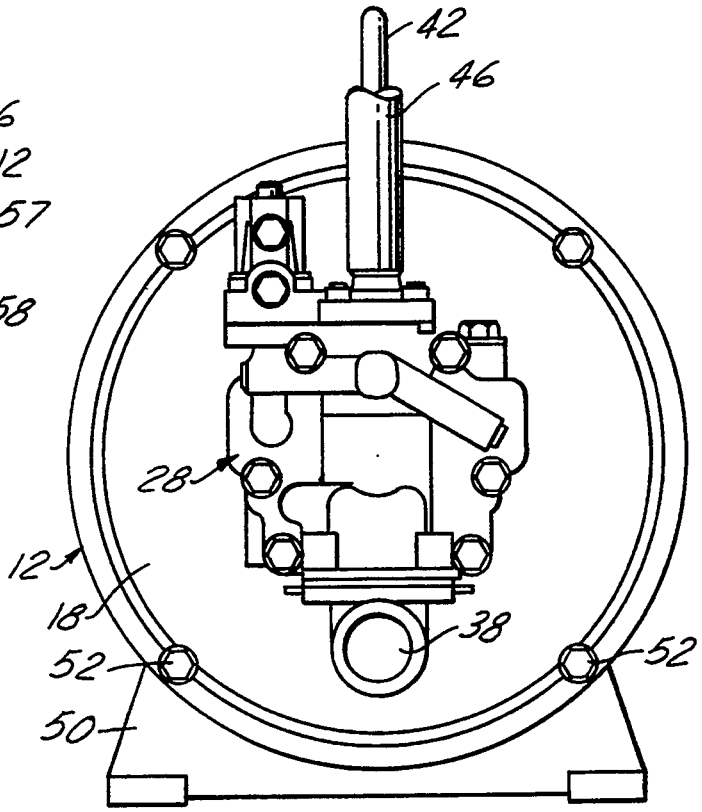
FIGS. 3 and 4 are end elevational views taken in the directions 3 and 4 in FIG. 1.
Figure 4:
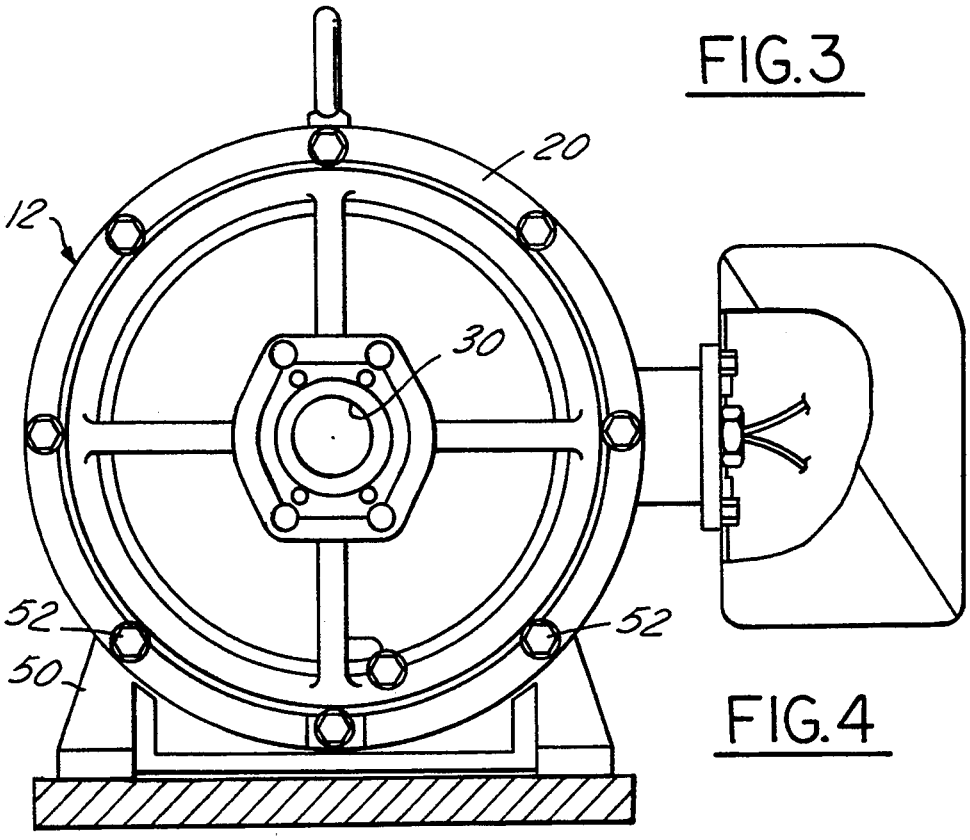
Figure 9:
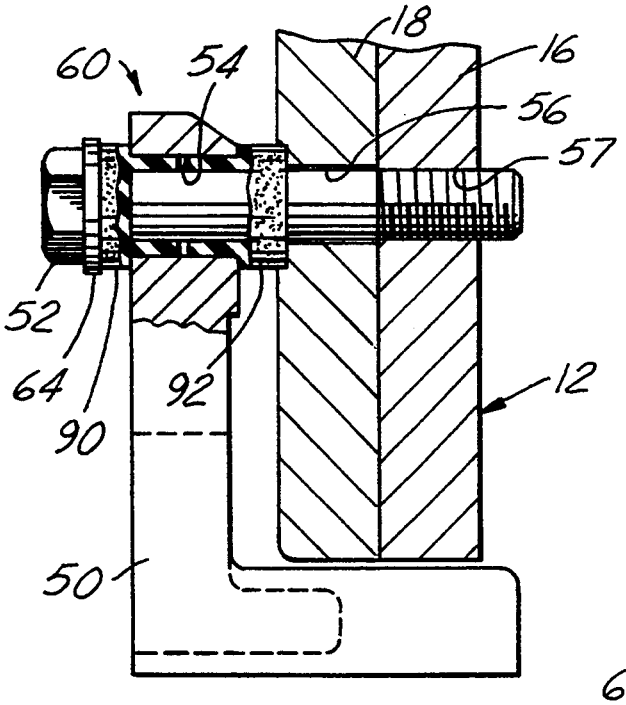
FIGS. 9, 10 and 11 are fragmentary views similar to that of FIG. 2 but showing modified embodiments of the invention.
Figure 10:
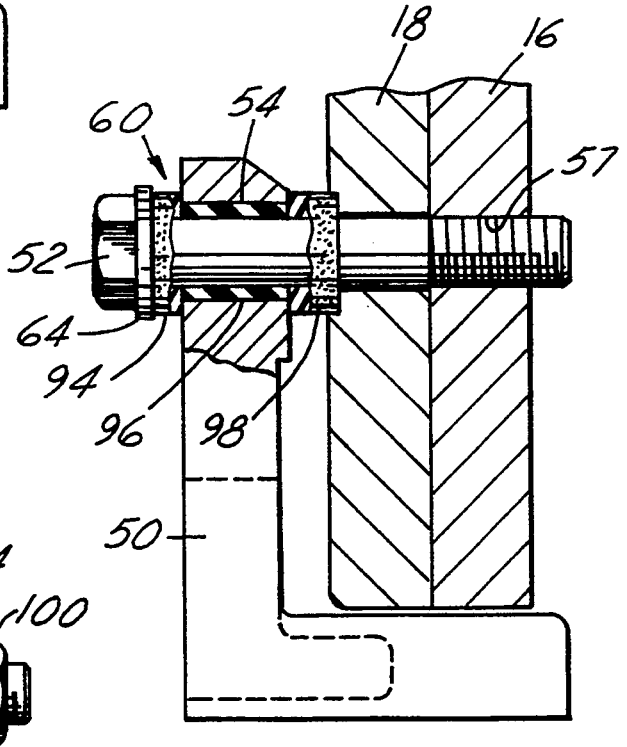
Figure 11:
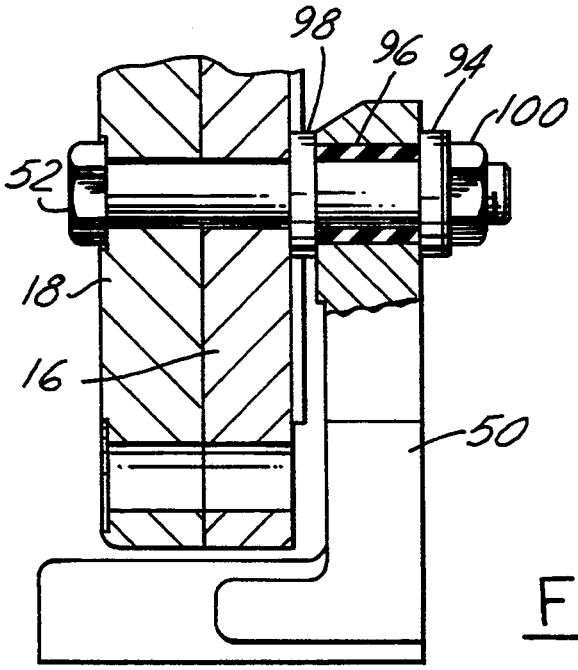

Mounting feet 50 are affixed to motor housing 12 and extend through sound enclosure 48 for mounting the unitary assembly to underlying support structure. In particular, and as best seen in FIG. 2, a bolt 52 extends through an opening 54 in support feet 50 at each side of motor housing 12 (FIGS. 3–4), and through an opening 56 in end members 18,20 into a threaded opening 57 in a flange 58 of motor housing case 16. A ferrule 60 of rubber or other suitable resilient vibration absorbing material radially surrounds the shank of bolt 52 within each foot opening 54. Each ferrule 60 has one end flange 62 axially interposed between the head of bolt 52 (and the washer 64) and foot 50, and a second end flange 66 axially interposed between foot 50 and motor housing 12. Ferrule 60 may be of unitary monolithic construction as illustrated in FIG. 2. Alternatively, ferrule 60 may comprise separate T-shaped ferrule segments that meet within or adjacent to foot opening 54 as shown in FIG. 9, or three separate collar and washer segments 94,96 and 98 as shown in FIG. 10. FIG. 11 illustrated as a modification to FIG. 10 in which bolt 52 threads into a nut 100, which eliminates internal threads 57 and simplifies manufacture.

Ferrule 60 isolates foot 50 from vibration energy at motor housing 12, and thus prevents transmission of vibration noise through foot 50 into the underlying support structure. In particular, the flange segments washer segments 62,66 (FIG. 2), 90,92 (FIG. 9) and 94,98 (FIG. 10) dampen transmission of axial vibration energy from the motor housing to the support foot, while the central ferrule segments dampen transmission of radial and torsional vibration. Best results are obtained when each ferrule is of unitary construction (FIG. 2). It will also be noted in FIG. 1 that the foot mounting bolts and ferrules are disposed within sound enclosure 48 to prevent radiation of airborne noise from the motor housing into the atmosphere at the foot/housing junction.

Figure 5:
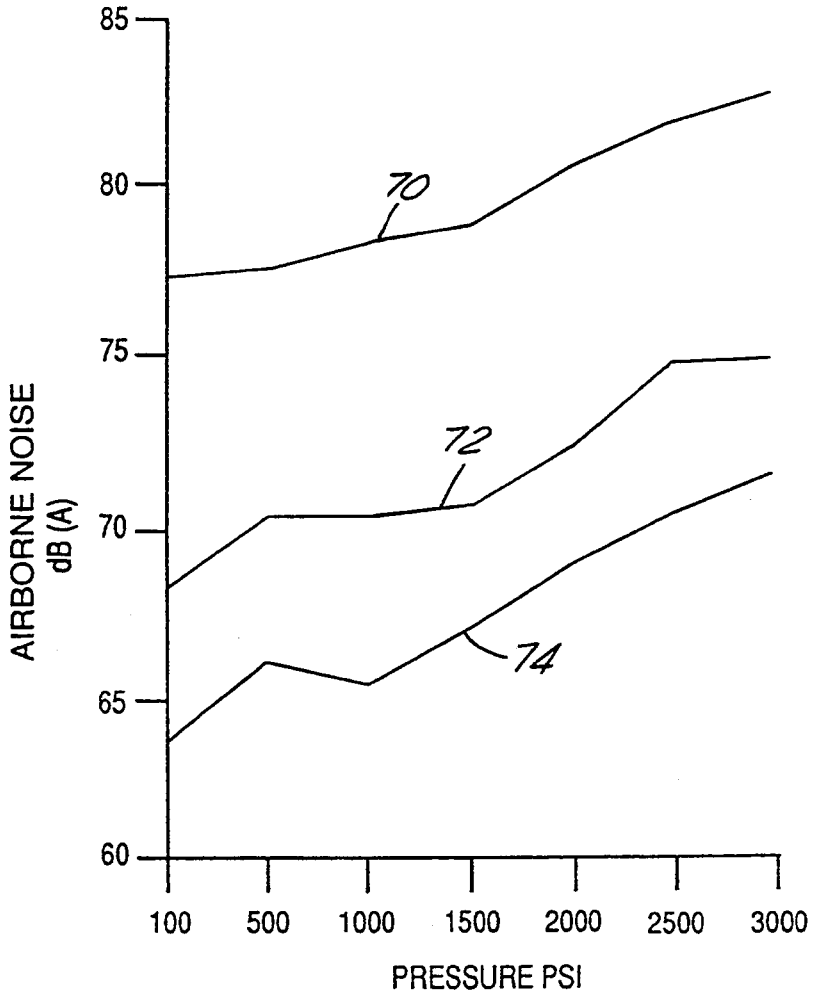
FIG. 5 is a graph that illustrates sound deadening properties of the embodiment of the invention illustrated in FIGS. 1–4.

FIG. 5 is a graph that illustrates ambient airborne noise in decibels (dB(A)) versus fluid pressure. The ambient noise comparisons illustrated in FIG. 5 were obtained using standard NMTBA noise measurement techniques, as specified by the National Machine Tool Builders Association, on motor/piston pump units operating at 1800 rpm. The top graph 70 in FIG. 5 illustrates operation of a conventional motor and piston pump arrangement in which the motor and pump were separate units connected by a coupler, and in which the motor was air cooled by a fan and a surrounding shroud. There were no sound enclosure 48 or foot isolation ferrules 60 in this construction. The middle graph 72 illustrates operation of a hybrid motor/pump construction of the type in FIG. 1 in which the fan and shroud were deleted, the motor was fluid cooled as in FIG. 1, the foot isolation ferrules 60 were employed, but there was no sound enclosure 48. The lower graph 74 illustrates operation of the embodiment of the invention illustrated in FIGS. 1–4, including both the foot isolation ferrules 60 and the sound enclosure 48. It will be noted that both the foot isolation ferrules alone (72) and the combination of the ferrules and sound enclosure 48 (74) achieved a marked reduction in ambient noise as compared with conventional arrangements (70).

Figure 6:
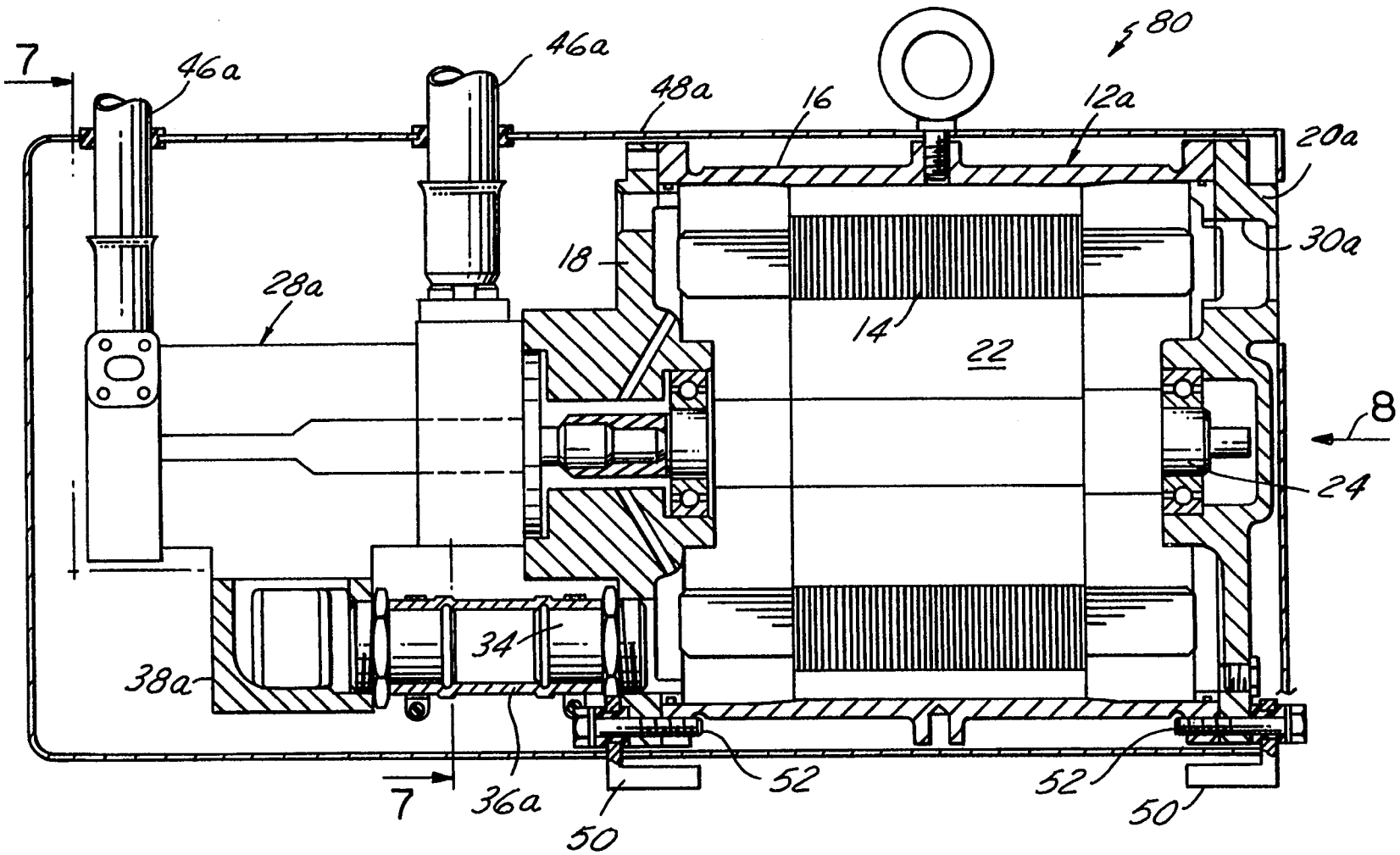
FIG. 6 is a sectional view that bisects an electric-motor/hydraulic-pump assembly in accordance with a second embodiment of the invention.
Figure 7:
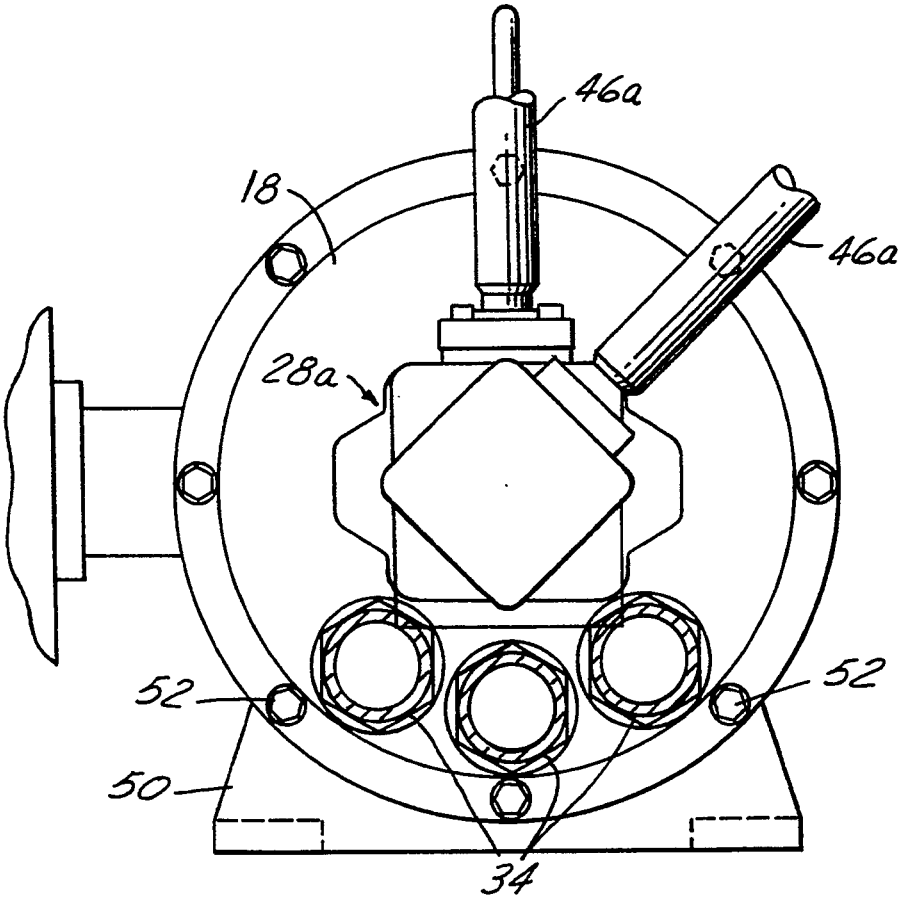
FIGS. 7 and 8 are end elevational views taken in the respective directions 7—7 and 8 in FIG. 6.
Figure 8:
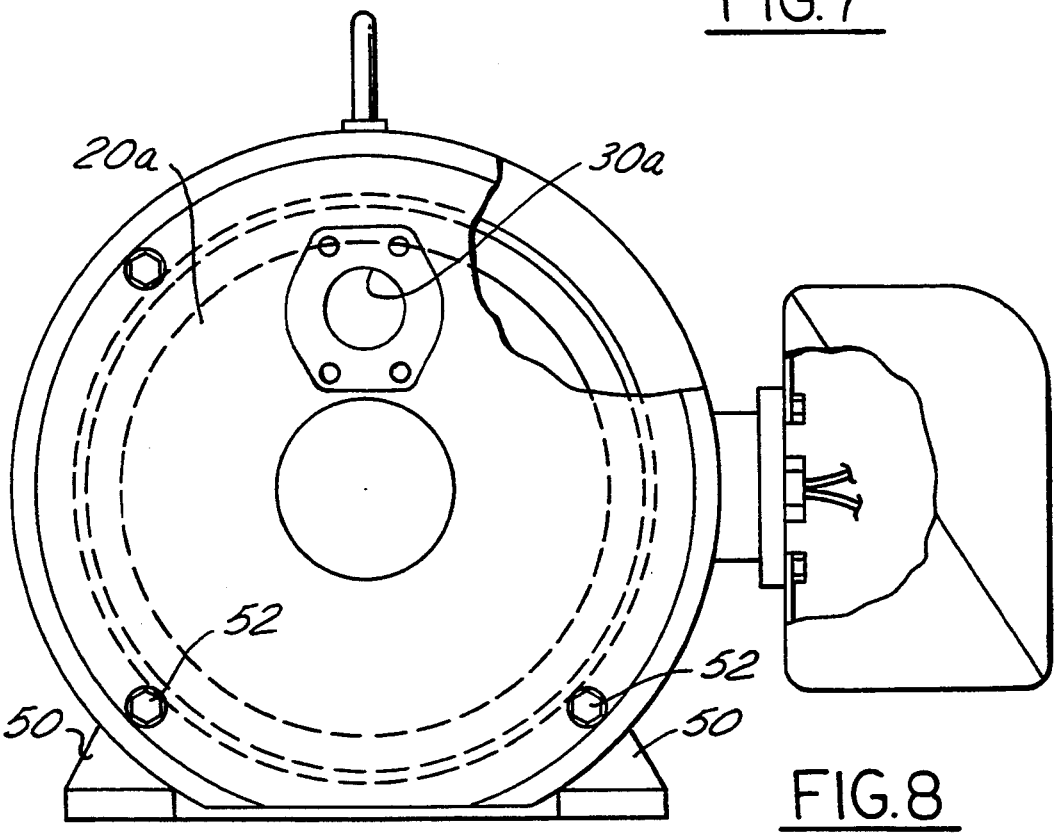

FIGS. 6–8 illustrate an electric-motor/hydraulic-pump assembly 80 in accordance with a second embodiment of the invention, in which reference numerals identical to those employed in connection with FIGS. 1–4 indicate identical or equivalent components, and reference numerals followed by a suffix indicate related components. In the assembly 80 of FIGS. 6–8, motor end member **20*a* has an off-center inlet port 30*a*, allowing a more compressed assembly construction. Pump unit 28*a* in this embodiment is dual vane pump unit that is mounted on motor housing end member 18, and receives inlet fluid through inlet fitting 38*a*, conduits 36*a* and fittings 34 on end member 18. The two vane pump sections within unit 28*a* provide separate outputs 46*a* through sound enclosure 48*a*. The mounting feet 50 and isolation ferrules 60 are as described in connection with FIGS. 1 and 2**.

We claim:

1. An electric-motor/hydraulic-pump assembly that comprises:

an electric motor having a motor housing and a motor shaft accessible at one end of said housing, a hydraulic pump coupled to said shaft and mounted to said one end of said motor housing to form a unitary assembly in which vibration generated by operation of said pump is transmitted to said motor housing, fluid passage means including inlet passage means for receiving fluid and directing such fluid through said motor housing to cool said motor and thence to said pump, and outlet passage means extending from said pump, support feet affixed to and extending from said motor housing for mounting said motor housing to a housing support structure, vibration damping means operatively interposed between said motor housing and said support feet to inhibit transmission of structure-borne noise from said motor housing to the housing support structure through said support feet, and a sound deadening enclosure surrounding and spaced from said pump and said motor housing to inhibit radiation of airborne noise from said pump and said motor housing, said sound deadening enclosure having apertures through which said support feet extend, said vibration damping means being disposed within said sound deadening enclosure.

2. The assembly set forth in claim 1 wherein said support feet are affixed to said motor housing by threaded fastening means within said sound deadening enclosure, said vibration damping means comprising means of resilient elastomeric construction operatively interposed between said thread fastening means and one of said housing and said feet.

* * * * *